US008020855B2

(12) United States Patent
Kawarago

(10) Patent No.: US 8,020,855 B2
(45) Date of Patent: Sep. 20, 2011

(54) SHEET FEEDING APPARATUS AND IMAGE FORMING APPARATUS

(75) Inventor: Atsushi Kawarago, Suntoh-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/557,622

(22) Filed: Sep. 11, 2009

(65) Prior Publication Data

US 2010/0001460 A1 Jan. 7, 2010

Related U.S. Application Data

(62) Division of application No. 11/855,245, filed on Sep. 14, 2007, now Pat. No. 7,607,657.

(30) Foreign Application Priority Data

Sep. 29, 2006 (JP) ..... 2006-267953

(51) Int. Cl.
*B65H 1/00* (2006.01)

(52) U.S. Cl. ..... 271/171

(58) Field of Classification Search ..... 271/171, 271/145

See application file for complete search history.

(56) References Cited

U.S. PATENT DOCUMENTS

| | | | | |
|---|---|---|---|---|
| 5,769,409 | A | 6/1998 | Nakamatsu et al. | 271/171 |
| 5,931,456 | A | 8/1999 | Laidlaw | 271/171 |
| 6,659,451 | B2 | 12/2003 | Kim | 271/145 |
| 7,377,509 | B2 | 5/2008 | Ito | 271/171 |
| 7,527,259 | B2 * | 5/2009 | Meetze et al. | 271/171 |
| 7,646,927 | B2 * | 1/2010 | Matsubara | 382/233 |
| 2005/0062218 | A1 | 3/2005 | Murakami et al. | 271/171 |
| 2006/0082044 | A1 | 4/2006 | Aida | 271/145 |
| 2008/0001346 | A1 | 1/2008 | Meetze et al. | 271/171 |

FOREIGN PATENT DOCUMENTS

JP 2001-88948 4/2001

* cited by examiner

*Primary Examiner* — Kaitlin Joerger

(74) *Attorney, Agent, or Firm* — Fitzpatrick, Cella, Harper & Scinto

(57) ABSTRACT

A sheet feeding apparatus including: a regulating member movable so as to regulate a position of a sheet in a sheet regulated position corresponding to the sheet to be contained in a cassette main body; a holding mechanism for holding the regulating member; and an operating portion disposed at the regulating member for releasing the regulating member from being held by the holding mechanism, wherein when the regulating member is moved in one direction or the other direction opposite to the one direction for regulating the sheet, the operating portion is press-operated in the direction intended to move so that the regulating member is released from being held by the holding mechanism.

8 Claims, 8 Drawing Sheets

SHEET FEEDING APPARATUS AND IMAGE FORMING APPARATUS

This is a divisional of U.S. patent application Ser. No. 11/855,245, filed Sep. 14, 2007, allowed Jun. 15, 2009.

BACKGROUND OF THE INVENTION

1. Field of the Invention

The present invention relates to a sheet feeding apparatus and an image forming apparatus and, more particularly, to a construction for positioning a regulating member to regulate the position of a sheet.

2. Description of the Related Art

Recently, in an image forming apparatus such as a printer or a copying machine, the one in which a sheet is fed to an image forming portion to form an image has been widely marketed. Furthermore, as such an image forming apparatus, typically a sheet feeding cassette is removably mounted onto an image forming apparatus main body, and a sheet that is contained in the sheet feeding cassette is automatically fed to the image forming portion by the sheet feeding apparatus.

As such a sheet feeding cassette for use in such an image forming apparatus, there is a universal cassette in which various sizes of sheets can be contained in the same cassette. In a sheet containing portion of this universal cassette, there is movably provided a trailing edge regulating member regulating a trailing edge of a sheet in a feeding direction of the sheet that is contained in the sheet containing portion. Furthermore, there is provided movably a side edge regulating member regulating a side edge of the sheet in a width direction orthogonal to the feeding direction of the sheet. Then, by moving the trailing edge regulating member and the side edge regulating member in alignment with the trailing edge and the side edge of a sheet to be contained to regulate the position of the side edge and the trailing edge of the sheet, various sizes of sheets can be contained.

Moreover, in such a universal cassette, by regulating the side edge of the sheet with the side edge regulating member, as well as by regulating the trailing edge with the trailing edge regulating member, a leading edge position of the sheet is to be set in a predetermined position at all times. Whereby, regardless of the size of a sheet, a stable feed of the sheet can be conducted.

In the meantime, when a universal cassette is mounted or dismounted with respect to an image forming apparatus main body, there are some cases where due to an inertial force of a sheet or an impact that is generated by mounting/dismounting operation, these regulating members are moved from a standard sheet regulated position. Furthermore, when the regulating member is moved in such a way, the state in which the sheet cannot be held in a standard position occurs, and thus failures such as a faulty feed, skew feed, and double feed of sheets are made to occur at the time of feed operation.

Thus, conventionally, for example, there has been a universal cassette in which a rack is provided at a cassette main body, as well as a stopper is provided at a regulating member; and by the engagement of the stopper with the rack, the regulating member is secured. Incidentally, in this universal cassette, the regulating member is released from being secured by disengaging the stopper with the use of a release lever that is disposed protruding from an outer wall of the regulating member. This art is described in Japanese Patent Application Laid-Open No. 2001-88948.

Incidentally, in such a conventional universal cassette, in the case where a regulating member is secured with a rack and a stopper, this method is effective with respect to the collision at the time of mounting or dismounting the cassette or the impact at the time of distribution. In addition, due to that the release lever for releasing the engagement of the stopper is disposed protruding from the outer wall of the regulating member, a positional adjustment of the regulating member can be made even in the state in which the sheets are stacked in the cassette, thus resulting in a high operability.

In the meantime, as to this release lever, for example, in the case where the regulating member is moved in a direction of regulating a sheet of a small size (hereinafter referred to as a smaller size regulation direction), when the release lever is pressed in the smaller size regulation direction, the engagement of a stopper will be released. On the other hand, in the case where the regulating member is moved in a direction of regulating a sheet of a large size (hereinafter referred to as a larger size regulation direction), the release lever needs to be once grubbed to release the engagement of the stopper with the rack.

That is, conventionally, in the case where the regulating member is moved in the smaller size regulation direction, when the release lever is pressed in the smaller size regulation direction, the engagement of the stopper is automatically released. However, in the case where the regulating member is moved in the larger size regulation direction, to release the engagement of the stopper, operation of grubbing the release lever needs to be done, and thus the ease of operation is impaired.

SUMMARY OF THE INVENTION

Thus, the present invention has been made in view of such present situations, and has an object of providing a sheet feeding apparatus and an image forming apparatus with which the movement operability of a regulating member can be improved.

The present invention is a sheet feeding apparatus provided with a regulating member movable for regulating a position of a sheet that is contained in a containing portion, the apparatus comprising: a holding mechanism holding the regulating member in a sheet regulated position corresponding to a sheet size; and an operating portion disposed at the regulating member and configured to release the regulating member from being held by the holding mechanism, wherein the regulating member can be moved in one direction or an other direction opposite thereto for regulating the sheet, and the operating portion is press-operated in the direction intended to move the regulating member, thereby the regulating member is released from being held by the holding mechanism.

Further features of the present invention will become apparent from the following description of exemplary embodiments with reference to the attached drawings.

DESCRIPTION OF THE EMBODIMENTS

Figure 1:
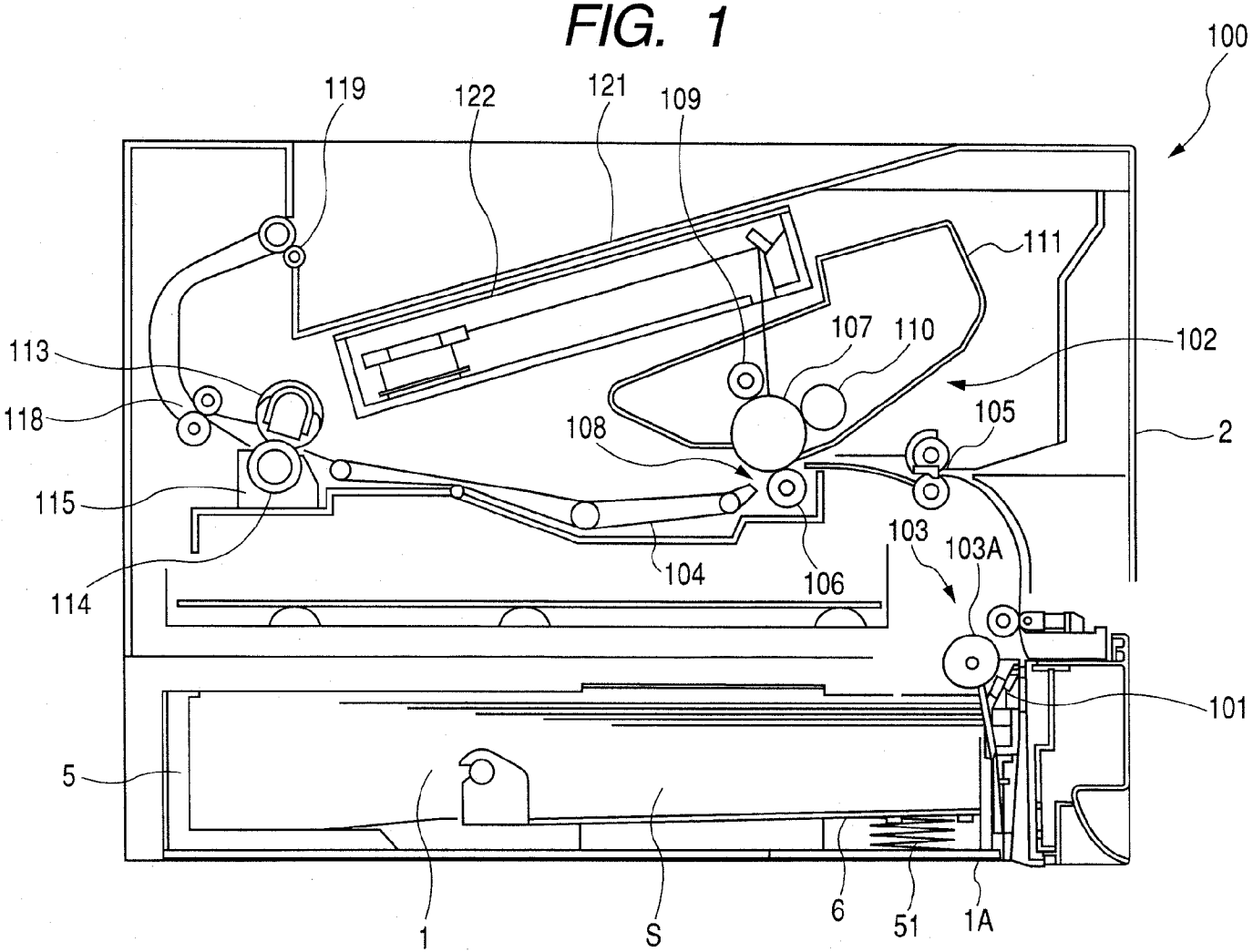
FIG. 1 is a sectional view of an image forming apparatus provided with a sheet feeding apparatus according to a first embodiment of the present invention.

Hereinafter, an exemplary embodiment for carrying out the present invention will be described in detail referring to the drawings.

FIG. 1 is a sectional view illustrating a schematic construction of a laser beam printer 100, being one example of an image forming apparatus provided with a universal cassette 1 according to an exemplary embodiment of the present invention. This universal cassette 1 is constructed to be removable with respect to an image forming apparatus main body 2. In FIG. 1, in the image forming apparatus main body (hereinafter referred to as an apparatus main body) 2 of the laser beam printer 100, there is provided an image forming portion 102 at which an image is formed by an electrophotographic method. A sheet feeding apparatus 103 feeds a sheet S to the image forming portion 102.

Here, this image forming portion 102 includes a photosensitive drum 107 forming a toner image, a transfer roller 106 transferring the toner image having been formed on the photosensitive drum 107 to the sheet S, a charging device 109 uniformly charging the surface of the photosensitive drum, and a developing device 110. Incidentally, a process cartridge 111 includes the photosensitive drum 107, the developing device 110, and the charging roller 109.

In addition, the sheet feeding apparatus 103 includes a universal cassette 1, being a sheet containing unit in which a large number of sheets S can be contained, and a feed roller 103A made of a high frictional material, being a sheet feeding portion disposed above the universal cassette 1 and configured to feed a sheet S contained in the universal cassette 1.

Moreover, the universal cassette 1 includes a cassette body 1A in which the sheet S is contained, and an intermediate plate 6 on which the sheet S is stacked, as well as which is held pivotally in a vertical direction with a shaft 50*a* being a fulcrum at the cassette body 1A and biased toward the feed roller 103A by a coil spring 51. Further, by pressing up this intermediate plate 6 toward the feed roller 103A by the coil spring 51, the sheets S that are stacked on the intermediate plate 6 are to be pressed to the feed roller 103A.

Furthermore, there is provided a separation pad 101, being a separation unit configured to separate the sheets having been fed out by the feed roller 103A one by one.

Now, an image forming operation of the laser beam printer 100 constructed in such a way will be described.

First, based on an image signal from a host computer (not illustrated), a laser beam is irradiated onto the photosensitive drum 107 which surface has uniformly been preliminarily charged by the charging roller 109, and which is rotated in a clockwise direction from a laser scanner 122 that is provided at the apparatus main body 2. Whereby, an electrostatic latent image is formed on the surface of the photosensitive drum 107. Next, the electrostatic latent image on the surface of the photosensitive drum 107 is developed with a toner on the developing roller 110, and a toner image is formed on the photosensitive drum 107.

On the other hand, the feed roller 103A starts to rotate in a predetermined timing, and in cooperation therewith, the intermediate plate 6 that is biased onto the feed roller side by the force of the coil spring 51 is rotated upward. As a result, a leading edge portion of the sheets S that are stacked on the intermediate plate 6 is brought into pressure contact with the feed roller 103A by a predetermined force. Here, the feed roller 103A is controlled so as to rotate in a counterclockwise direction only at the time of feeding a sheet, and feeds the pressure-contact sheet S by a frictional force. Incidentally, when plural sheets S on the intermediate plate 6 are fed out at the same time, only the uppermost sheet S is separated from the others by the action of the separation pad 101 to be conveyed to the downstream.

Next, the uppermost sheet S having being separated by the separation pad 101 in such a way is fed to a registration unit 105, and a skew feed thereof is corrected. Thereafter, the sheet S is conveyed by the registration unit 105 to a transfer portion 108 that is formed of the photosensitive drum 107 and a transfer roller 106. At the transfer portion 108, the toner image having been formed on the photosensitive drum 107 as already described is electrically attracted by the transfer roller 106 to be transferred to the sheet S.

Incidentally, the sheet S onto which the toner image has been transferred with the arrangement is thereafter conveyed to a fixing unit 115 that is formed of a heating unit 113 and a pressure roller 114 by a conveying belt 104. Due to that this sheet S is heated and pressed at this fixing unit 115, the toner image will be fixed. Further, thereafter, the sheet S is discharged onto a sheet discharge tray 121 on the top of the apparatus main body by a pair of intermediate discharge rollers 118 and a pair of discharge rollers 119.

Figure 2:
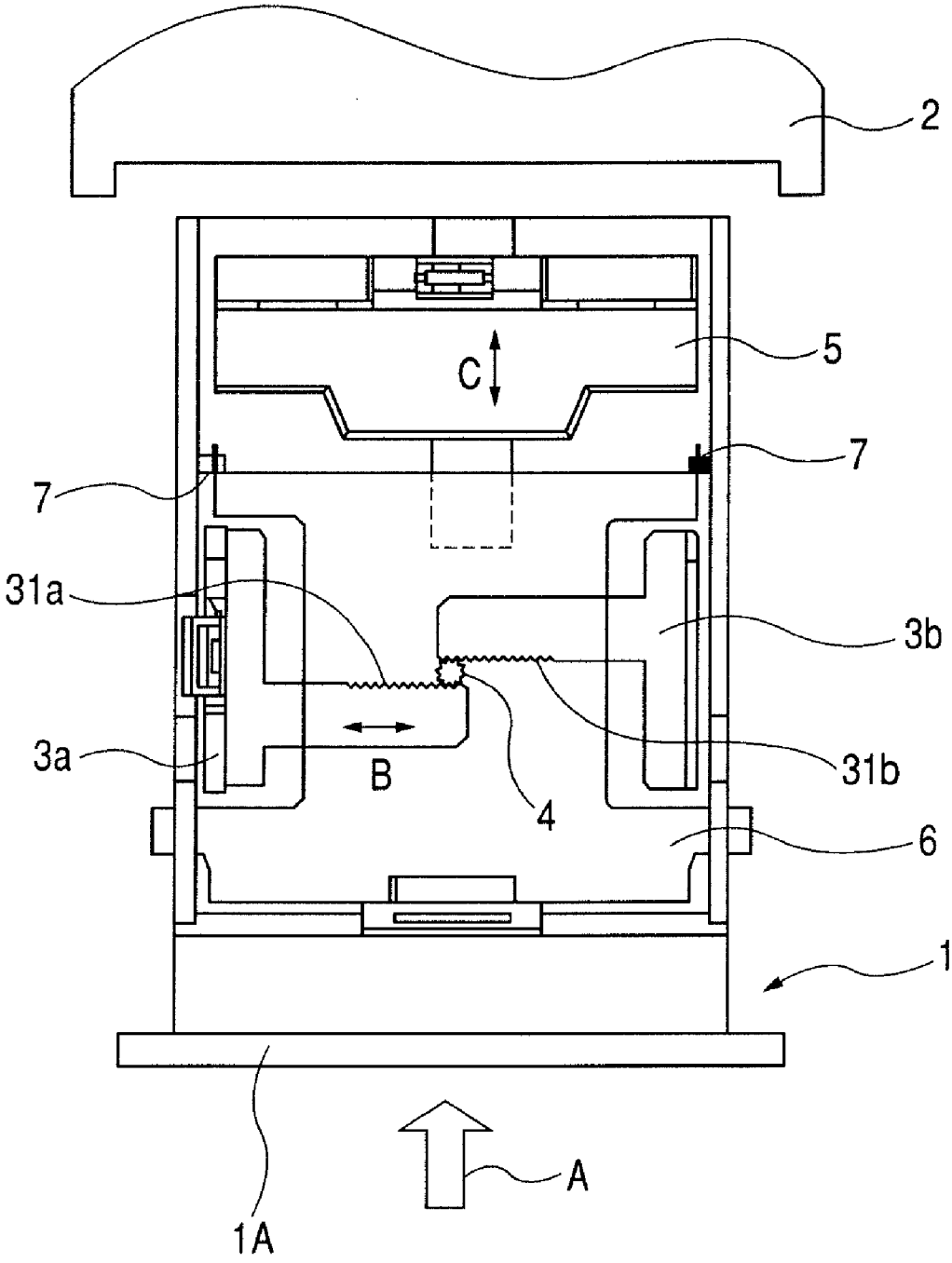
FIG. 2 is a schematic plan view of a universal cassette, being one example of a sheet feeding cassette provided at the above-mentioned sheet feeding apparatus.

FIG. 2 is a view illustrating an internal part of the universal cassette 1. This universal cassette 1 includes a cassette body 1A in which various sizes of sheets are contained, a pair of side edge regulating member (side edge regulating plates) 3*a* and 3*b* configured to regulate a side edge position of the sheet, and a trailing edge regulating member (trailing edge regulating plate) 5 configured to regulate a trailing edge position of the sheet. Incidentally, the side edge regulating members 3*a* and 3*b* and the trailing edge regulating member 5 are disposed so as not to affect a pivotal operation of the intermediate plate 6.

Then, when various sizes of sheets are contained in the cassette body, the side edge regulating members 3*a* and 3*b* are brought into contact with the side edge of the sheet to regulate the side edge position of the sheet, as well as the trailing edge regulating member 5 is brought into contact with the trailing edge of the sheet to regulate the trailing edge position of the sheet. Whereby, the sheet can be contained in a positioned state.

Incidentally, when a sheet is fed, the universal cassette 1 is mounted in the apparatus main body 2 from a direction indicated by an arrow A. The intermediate plate 6 is pressed upward about a support shaft 7 by the spring 51. Whereby, the sheet that is positioned by the side edge regulating members 3*a* and 3*b* and the trailing edge regulating member 5 is pressed to the feed roller 103A. Incidentally, the sheets having been pressed to the feed roller 103A are fed out one by one by a feeding action of the feed roller 103A to be fed to the image forming portion 102.

In the meantime, a pair of the side edge regulating members 3*a* and 3*b* is provided with rack portions 31*a* and 31*b* extended in the same direction (direction indicated by an arrow B) as the width direction, being a moving direction of the side edge regulating members 3*a* and 3*b* at bottom portions respectively. Furthermore, these rack portions 31*a* and 31*b* are guided by a guide groove (not illustrated) provided in the direction indicated by the arrow B at a bottom plate of the cassette body 1A to be movable in the width direction.

Incidentally, a pinion 4 is provided rotatably at a central portion on the bottom face of the caste body 1A. With this pinion 4, rack teeth that are formed at the rack portions 31*a* and 31*b* are meshed and engaged respectively. With the arrangement, when either of the side edge regulating members is made to move in the width direction, by the action of the pinion 4 and the rack portions 31*a* and 31*b*, the other side edge regulating member is cooperated to move in the direction opposite to one side edge regulating member.

Then, by causing both of the side edge regulating members 3*a* and 3*b* to move in the width direction at the same time by the movement of one side edge regulating member in such a way to bring them into contact with the side edge of sheets stacked on the intermediated plate 6, the sheets can be easily positioned in the width direction.

Figure 3:
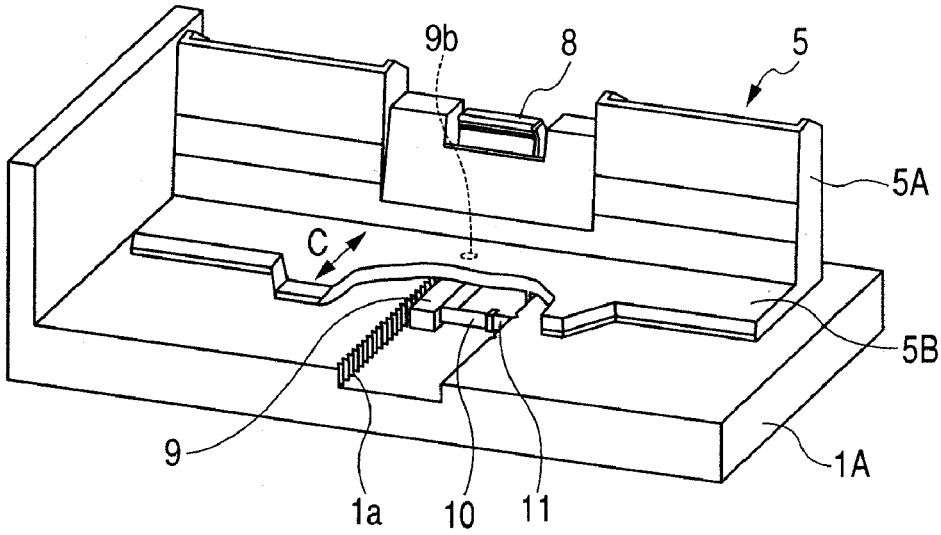
FIG. 3 is a perspective view illustrating a construction of a trailing edge regulating member of the above-mentioned universal cassette.

The trailing edge regulating member 5 is guided by a guide groove (not illustrated) provided in a direction indicated by an arrow C in the bottom plate of the cassette body 1A to be movable in a feeding direction. In addition, as illustrated in FIG. 3, there are provided a main body portion 5A to be contacted with the trailing edge of the sheet, a slide portion 5B on which the main body portion 5A is vertically provided, and a holding member 9 that is engaged with the cassette body 1A with the below-described engaging portion to hold the trailing edge regulating member 5 in a predetermined position.

Furthermore, there is provided an operating portion 8 that operates the trailing edge regulating member 5, and that releases the engagement of the holding member 9 with the cassette body 1A by the below-described interlock so that the trailing edge regulating member 5 is movable. Then, in the case where this operating portion 8 is operated to release the engagement of the holding member 9 with the cassette body 1A, the trailing edge regulating member 5 comes to be movable, thus enabling to change a set position. Furthermore, after the trailing edge regulating member 5 has been operated to move, the holding member 9 will be engaged with the cassette body 1A again, thereby enabling to hold the position.

Figure 4:
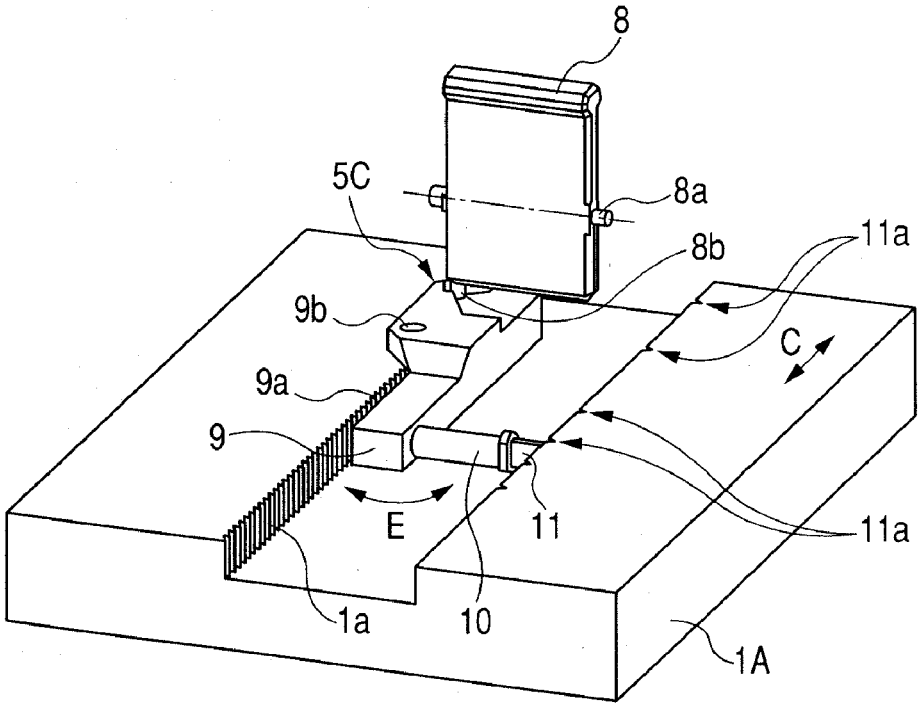
FIG. 4 is a perspective view illustrating a holding member and an operating portion of the above-mentioned trailing edge regulating member.

Moreover, at the trailing edge regulating member 5, as illustrated in FIG. 4, there is provided a click pin 11 that is moved integrally with the trailing edge regulating member 5, as well as that is pressed by an elastic member 10 in a direction orthogonal to the moving direction of the trailing edge regulating member 5.

Further, when the trailing edge regulating member 5 is moved to a position of regulating a trailing edge position of a standard-size sheet, this click pin 11 is elastically engaged with a click groove 11*a* formed in positions corresponding to standard-size positions of sheets in the cassette body 1A, a click feeling is generated. Owing to such construction, since the click feeling is generated when the trailing edge regulating member 5 is set in the standard-size positions of sheets, the operability when a user operates the trailing edge regulating member 5 is improved.

Figure 5:
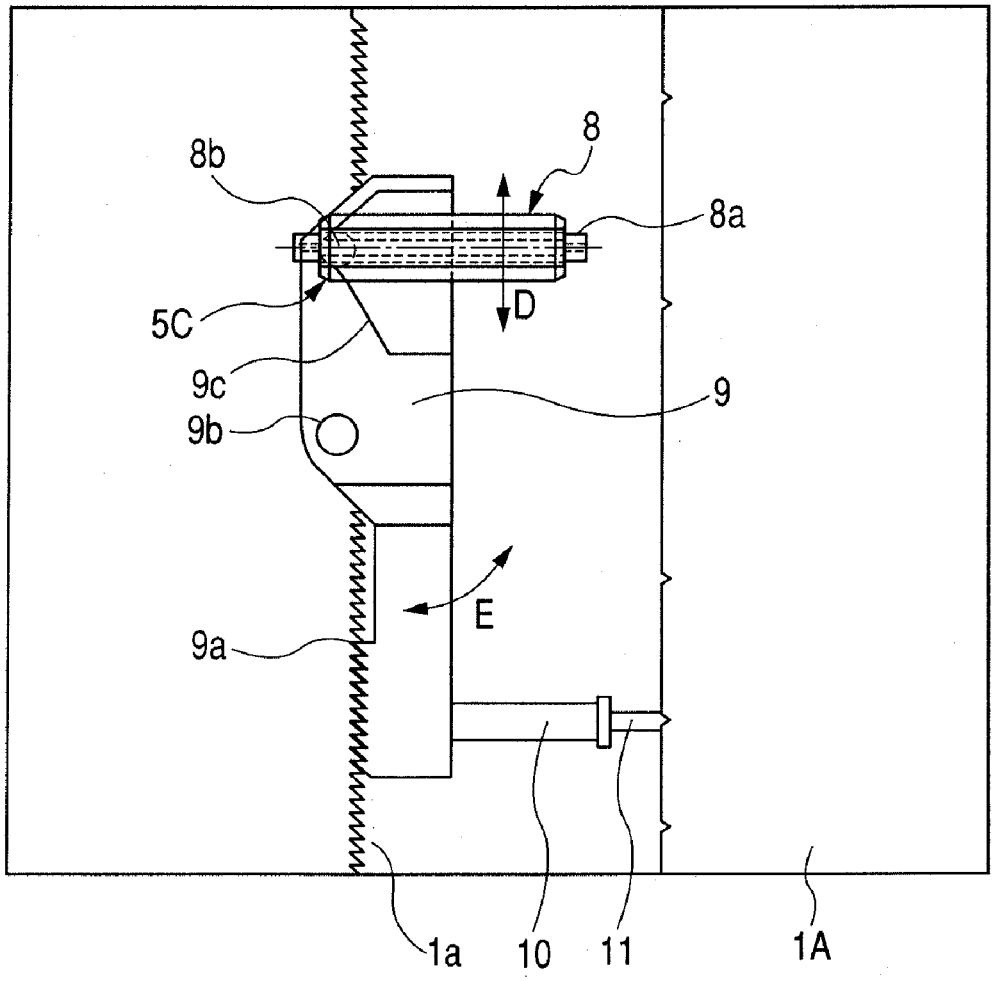
FIG. 5 is a plan view illustrating an interlock of the above-mentioned trailing edge regulating member.

The holding member 9, as illustrated in FIG. 5, is provided with a tooth row 9*a*, being an engaging portion that is formed of a plurality of triangular teeth at the side face. This tooth row 9*a* is engaged with a rack tooth row 1*a*, being an engaged portion that is provided at the bottom of the cassette body 1A, and that is formed of triangular teeth. Then, by the engagement of the tooth row 9*a* with the rack tooth row 1*a* in such a way, the trailing edge regulating member 5 is held (secured) in a set position corresponding to a sheet size. These tooth row 9*a* of the holding member 9 and rack tooth row 1*a* of the cassette body 1A form a holding mechanism.

Here, as in this embodiment, due to that the teeth of the tooth row 9*a* and the rack tooth row 1*a* are triangular teeth, a high holding strength can be ensured mechanically. As a result, since the pitch of the tooth row 9*a* and the rack tooth row 1*a* can be made smaller, fine adjustments of a set position of the trailing edge regulating member 5 can be conducted.

Moreover, in this embodiment, as illustrated in FIG. 5, the teeth of the tooth row 9*a* and rack tooth row 1*a* are shaped to have a substantially perpendicular face on the side of a larger size regulation direction such that a large resistance is generated when the trailing edge regulating member 5 is moved in the larger size regulation direction. Further, in the case where the trailing edge regulating member 5 is applied with a force in the larger size regulation direction, respective substantially perpendicular faces of the tooth row 9*a* and the rack tooth row 1*a* are brought into pressure contact with each other.

With the arrangement, in the case where the trailing edge regulating member 5 is applied with the force in the larger size regulation direction, due to that respective substantially perpendicular faces of the tooth row 9*a* and the rack tooth row 1*a* are brought into contact with each other, this force can be received. Whereby, a high holding force of the trailing edge regulating member 5 can be ensured.

In addition, the holding member 9 is pivotably provided in a direction indicated by an arrow E about a pivot shaft 9*b* at a slide portion 5B (refer to FIG. 3) of the trailing edge regulating member 5. This pivot shaft 9*b* is provided in a position in which a force is applied in a direction of the tooth row 9*a* being engaged with the rack tooth row 1*a* in the case where the trailing edge regulating member 5 is applied with a force in a direction of making the size larger.

In addition, the holding member 9 is biased to the rack tooth row 1*a* side by an elastic member 10 for biasing the click pin 11, whereby the holding member 9 is held in a state in which the tooth row 9*a* is engaged with the rack tooth row 1*a*. As a result, the trailing edge regulating member 5 is engaged with the cassette body 1A to be held.

The operating portion 8, as illustrated in FIGS. 3 and 5, is pivotably provided in a direction indicated by an arrow D about a support shaft 8*a* at the upper portion of the main body portion 5A of the trailing edge regulating member 5. At the bottom of this operating portion 8, there is provided a shaft 8*b* to fit with play remaining in a V-shaped groove 9*c* that is formed in the holding member 9, and is extended in a direction indicated by an arrow D, being an abutting portion. Incidentally, this shaft 8*b* of this operating portion 8 and groove 9*c* formed at the other pivoting end portion of the holding member 9 form an interlock 5C configured to release the engagement between the holding member 9 of the trailing edge regulating member 5 and the cassette body 1A in cooperation with operation of the operating portion 8.

Figure 6A:
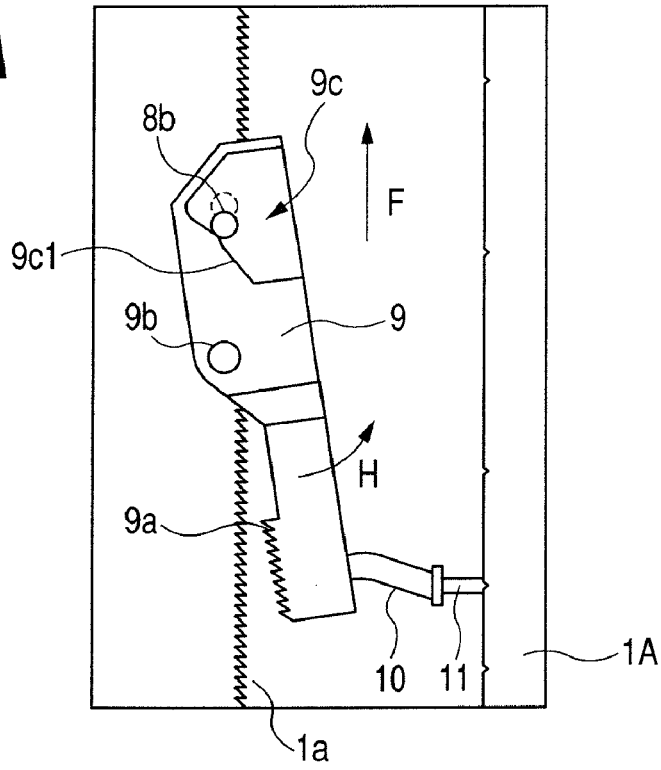
FIGS. 6A and 6B are plan views illustrating states of the interlock when the operating portion of the above-mentioned trailing edge regulating member is pivotally operated.
Figure 6B:
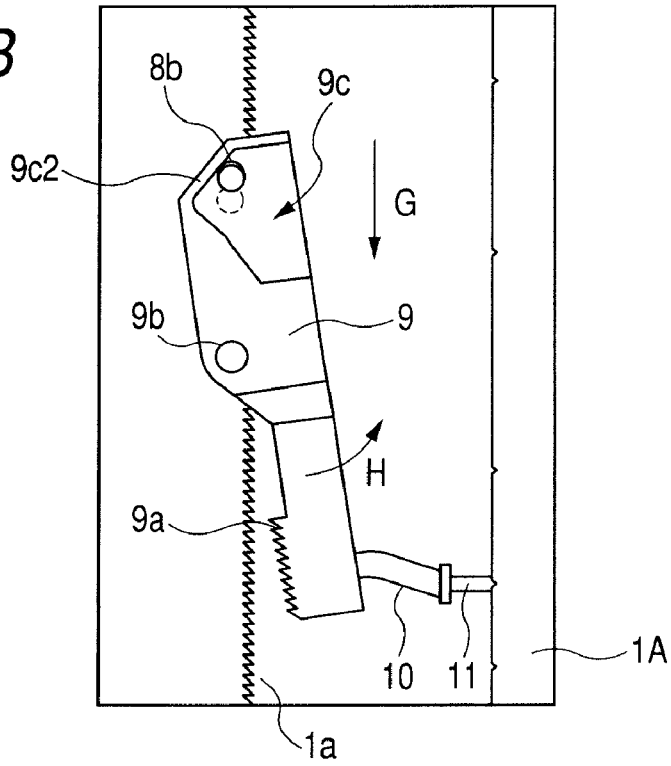

FIGS. 6A and 6B are plan views illustrating the state of the interlock 5C when the operating portion 8 is operated based on the size of a sheet.

For example, to contain a sheet of a large size, when the operating portion 8 is pressed in the same direction indicated by an arrow F as the moving direction of the trailing edge regulating member 5 so as to move the tailing edge regulating member 5 in the larger size regulation direction indicated by an arrow F in FIG. 6A, the operating portion 8 is pivoted with the support shaft 8*a* (refer to FIGS. 4 and 5) being a fulcrum. Accompanied thereby, the shaft 8*b* that is fit with play remaining in the V-shaped groove 9*c* is moved in the direction opposite to the direction indicated by the arrow F, and presses one pressing face 9*c*1 of the groove 9*c*.

Whereby, the holding member 9 is pivoted in a direction indicated by an arrow H, being a direction of the engagement with the cassette body 1A being released about the pivot shaft 9*b*, and thus the tooth row 9*a* will be disengaged from the rack tooth row 1*a*. Due to that the engagement between the tooth row 9*a* and the rack tooth row 1*a* is released in such a way, thereafter, when the trailing edge regulating member 5 is moved in the larger size regulation direction to change a set position, the tailing edge regulating member 5 can be easily moved.

Incidentally, after having been moved, when the operating portion 8 is released from being pressed, the operating portion 8 is returned to the original state in which the tooth row 9*a* and the rack tooth row 1*a* are engaged with each other, and thus the trailing edge regulating member 5 can be held in a set position.

In addition, to contain a sheet of a small size, when the operating portion 8 is pressed in the same direction indicated by an arrow G as the moving direction of the trailing edge regulating member 5 so as to move the trailing edge regulating member 5 in the smaller size regulation direction indicted by an arrow G in FIG. 6B, the operating portion 8 is pivoted with the support shaft 8*a* being a fulcrum. Accompanied thereby, the shaft 8*b* that is fit with play remaining in the V-shaped groove 9*c* is moved in the direction opposite to the direction indicated by an arrow G and presses the other pressing face 9*c*2 of the groove 9*c*.

Whereby, the holding member 9 is pivoted in a direction indicated by an arrow H about the pivot shaft 9*b*, and the engagement between the tooth row 9*a* and the rack tooth row 1*a* is released, thus enabling to move the trailing edge regulating member 5 in the smaller size regulation direction to change a set position. Incidentally, after having been moved, when the operating portion 8 is released from being pressed, by the action of the elastic member 10, the operating portion 8 is returned to the original state in which the tooth row 9*a* and the rack tooth row 1*a* are engage with each other, and thus the trailing edge regulating member 5 can be held in the set position.

With the arrangement, by the interlock 5C according to this embodiment, in both directions (directions indicated by the arrows F and G) in which the operating portion 8 is press-operated, the holding member 9 is pivoted in the direction indicted by the arrow H, and the engagement between the tooth row 9*a* and the rack tooth row 1*a* is released, so that the trailing edge regulating member 5 can be moved.

That is, in this embodiment, when the operating portion 8 is operated to move the trailing edge regulating member 5, only by press-operating the operating portion 8 in the same direction as the direction intended to move the trailing edge regulating member 5, the engagement of the holding member 9 can be released. Whereby, by pressing the trailing edge regulating member 5 in the same direction as the pivoted direction of the operating portion 8 while the operating portion 8 is being pivoted, the trailing edge regulating member 5 can be moved by a series of operation, thus to improve the movement operability of the tailing edge regulating member 5. That is, only by pressing the operating portion 8 in a direction intended to move the trailing edge regulating member 5, the trailing edge regulating member 5 can be moved.

Note that, although in this embodiment, the shaft 8*b* forming the interlock 5C is provided at the operating portion 8 and the groove 9*c* is provided at the holding member 9, the shaft 8*b* may be provided at the holding member 9 and the groove 9*c* may be provided at the holding member 9. Furthermore, although in this embodiment, an example in which the present invention is applied to the trailing edge regulating member 5 is shown, the same construction can be applied to the side edge regulating members 3*a* and 3*b*. Whereby, even in the side edge regulating members 3*a* and 3*b*, such an effect that a movement operability can be improved, can be obtained.

Now, a second exemplary embodiment according to the present invention will be described.

Figure 7:
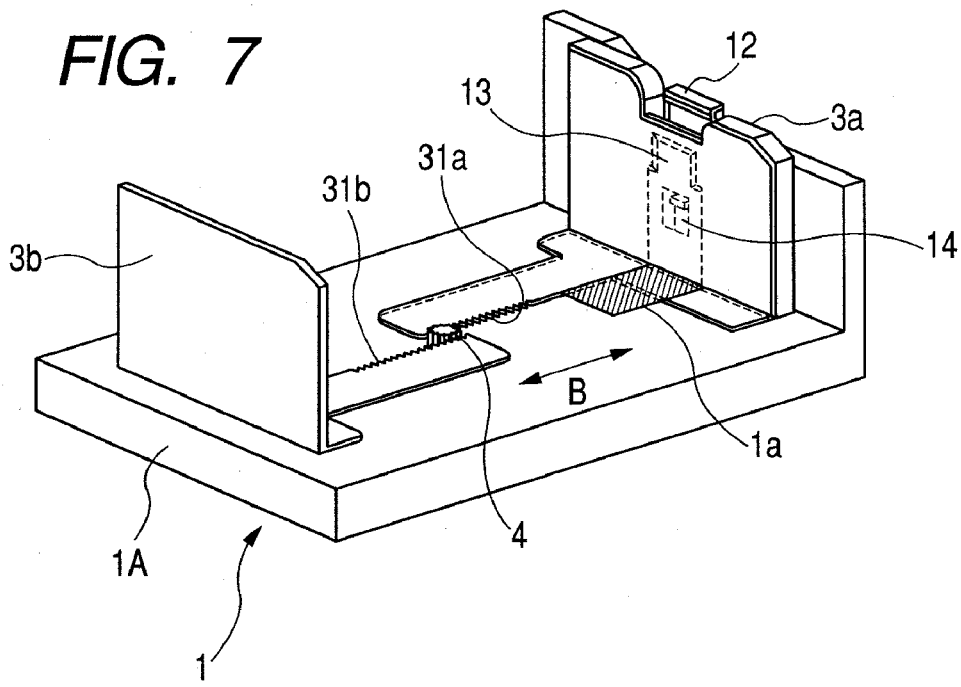
FIG. 7 is a perspective view illustrating a construction of a universal cassette, being one example of a sheet feeding cassette provided at a sheet feeding apparatus according to a second embodiment of the present invention.

FIG. 7 is a perspective view illustrating a construction of a universal cassette, being one example of a sheet feeding cassette to be provided at a sheet feeding apparatus according to this embodiment. Incidentally, in FIG. 7, the same reference numerals as those of FIG. 2 refer to identical or corresponding parts.

Figure 8:
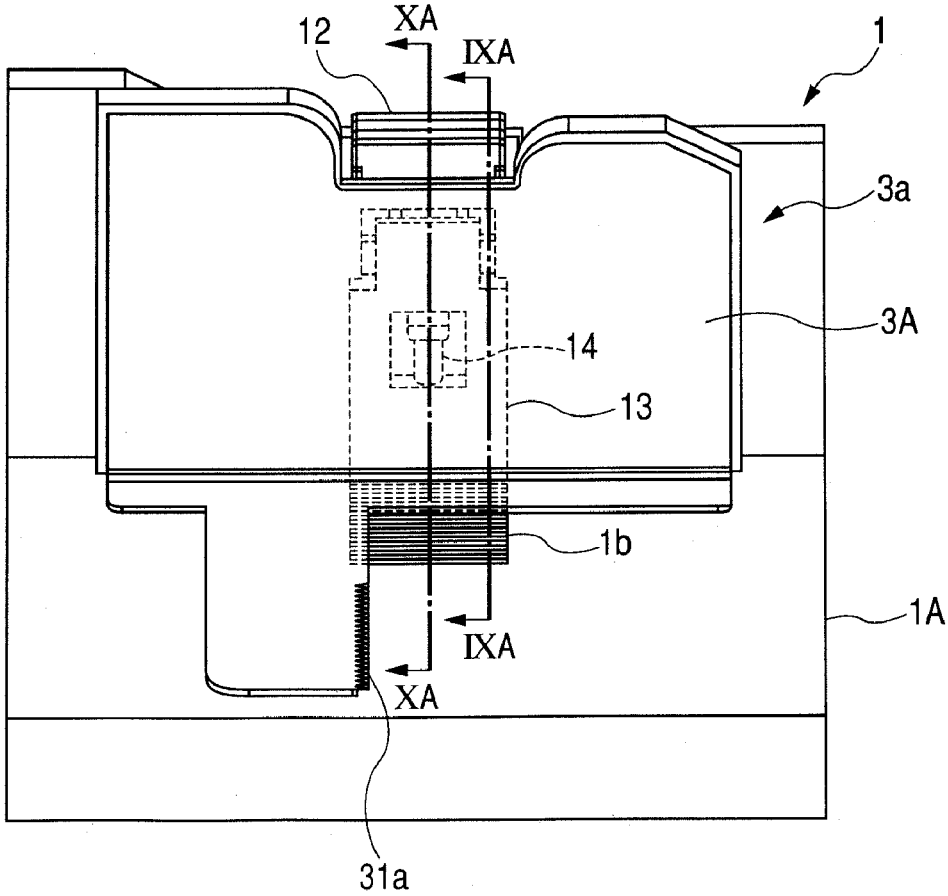
FIG. 8 is a view illustrating a construction of a side edge regulating member of the above-mentioned universal cassette.

In this embodiment, as described above, a pair of the side edge regulating members 3*a* and 3*b* is constructed such that rack teeth formed at rack portions 31*a* and 31*b* are in meshing engagement with a pinion 4 respectively, and thus when one side edge regulating member is moved in the width direction, the other side edge regulating member is moved in the direction opposite to the one side edge regulating member in association with the movement of the other side edge regulating member. Furthermore, one side edge regulating member 3*a* of a pair of the side edge regulating members 3*a* and 3*b* to be guided by a guide groove (not illustrated) that is formed in a direction indicated by the arrow B at a bottom plate of a cassette body is provided with a holding member 13 that is engaged with the cassette body 1A with the below-described engaging portion to hold a predetermined position. In addition, this one side edge regulating member 3*a*, as illustrated in FIG. 8, is provided with an operating portion 12 configured to release the engagement of the holding member 13 by the below-described interlock to be movable.

Furthermore, by operating the operating portion 12 to disengage the holding member 13 from the cassette body 1A, one side edge regulating member 3*a* can be moved to change a set position. Furthermore, after having been moved, the holding member 13 is engaged with the cassette body 1A again, whereby the set position of a pair of the side edge regulating members 3*a* and 3*b* can be held.

Figure 9A:
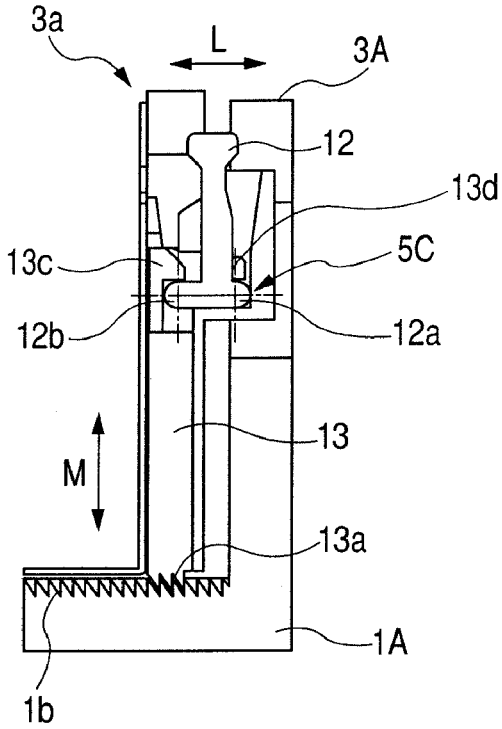
FIGS. 9A and 9B are sectional views taken along the line IXA-IXA of FIG. 8 illustrating states of an interlock when an operating portion of the above-mentioned side edge regulating members is pivotally operated.
Figure 9B:
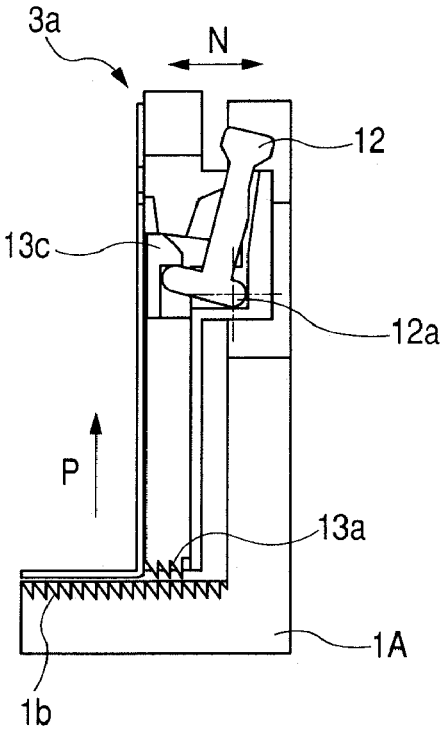

According to this embodiment, at the bottom face of the holding member 13, as illustrated in FIGS. 9A and 9B, there is provided a triangular tooth row 13*a* forming an engaging portion. This tooth row 13*a* is provided at the bottom of the cassette body 1A and engaged with a rack tooth row 1*b*, being an engaged portion formed of triangular teeth. Furthermore, the holding member 13 is provided slidably in a vertical direction indicated by an arrow M at the side edge regulating member 3*a*, as well as biased to the rack tooth row 1*b* side by an elastic member 14 illustrated in FIG. 7.

Therefore, by the tooth row 13*a* being engaged with the corresponding rack tooth row 1*b* as well as biased to the rack tooth row side by the elastic member 14, one side edge regulating member 3*a* will be engaged with a cassette body 1A, and a pair of the side edge regulating members 3*a* and 3*b* is held in a set position corresponding to a sheet size. These teeth row 13*a* of the holding member 13 and rack tooth row 1*b* of the cassette body 1A form a holding mechanism.

Here, as this embodiment, due to that the teeth of the tooth row 13*a* and the rack tooth row 1*b* are triangular, a high holding strength can be ensured mechanically. As a result, since the pitch of the tooth row 13*a* and the rack tooth row 1*b* can be made smaller, fine adjustments of the set position of the side edge regulating members 3*a* and 3*b* can be conducted.

Furthermore, in this embodiment, as illustrated in FIGS. 9A and 9B, the teeth of the tooth row 13*a* and the rack tooth row 1*b* are shaped to have a substantially perpendicular face on the side of a larger size regulation direction such that a large resistance is generated when the side edge regulating members 3*a* and 3*b* are moved in the larger size regulation direction. In addition, in the case where the side edge regulating members 3*a* and 3*b* are applied with a force in the larger size regulation direction, respective substantially perpendicular faces of the tooth row 13*a* and the rack tooth row 1*b* are brought into pressure contact with each other.

With the arrangement, in the case where the side edge regulating members 3*a* and 3*b* are applied with the force in the larger size regulation direction, respective substantially perpendicular faces of the tooth row 13*a* and the rack tooth row 1*b* are brought into pressure contact with each other, whereby this force can be received. As a result, a large holding power of the side edge regulating members 3*a* and 3*b* can be ensured.

In this embodiment, the operating portion 12 includes two shafts 12*a* and 12*b*. When the operating portion 12 is pressed, depending on a pressing direction, the operating portion 12 is to be pivoted in a direction indicated by an arrow L with respect to the side edge regulating member main body 3A with one of these two shafts 12*a* and 12*b* as a fulcrum.

Furthermore, in this embodiment, when the operating portion 12 is pressed, the operating portion 12 is pivoted with one of the support shafts 12*a* and 12*b* as a fulcrum, as well as the other support shaft 12*a*, 12*b* is to press upward a pressing portion 13*c*, 13*d* that is provided at the upper portion of the holding member 13. Whereby, the holding member 13 is moved slidingly upward, the teeth of the tooth row 13*a* and the rack tooth row 1*b* are spaced apart to release the engagement between the holding member 13 and the cassette body 1A, and thus one side edge regulating member 3*a* can be moved.

In this embodiment, the two support shafts 12*a* and 12*b* of the operating portion 12 and the pressing portions 13*c* and 13*d* that are provided at the upper portion of the holding member 13 form an interlock 5C configured to release the engagement between the holding member 13 of one side edge regulating member 3*a* and the cassette body 1A in association with the operation of the operating portion 12.

Now, with reference to FIGS. 9A, 9B, 10A and 10B, the state of the interlock 5C when the operating portion 8 is operated based on the size of sheets will be described.

For example, to contain a sheet of a large size, when the operating portion 12 is pressed in the same direction indicated by an arrow N as a moving direction of the operating portion 12 so as to move one side edge regulating member 3*a* in the larger size regulation direction indicated by the arrow N in FIG. 9B from the state of FIG. 9A, and thus when the operating portion 12 is pivoted with the support shaft 12*a* being the fulcrum, the support shaft 12*b* is brought into contact with a pressing portion 13*c* to press the holding member 13 upward (direction indicated by an arrow P).

Whereby, the engagement between the tooth row 13*a* provided at the holding member 13 and the rack tooth row 1*b* provided at the cassette body 1A is released, and one side edge regulating member 3*a* can be moved. Thus, one side edge regulating member 3*a* can be moved in the larger size regulation direction to change a set position. Accompanied by this movement, the other side edge regulating member 3*b* is moved in the direction opposite to the moving direction of one side edge regulating member 3*a*. Incidentally, after having been moved, when the operating portion 12 is released from being pressed, by the action of the elastic member 14, the operating portion 12 is returned to the original state in which the tooth row 13*a* and the rack tooth row 1*b* are engaged with each other, and thus the side edge regulating members 3*a* and 3*b* can be held (secured) in a set position.

Figure 10A:
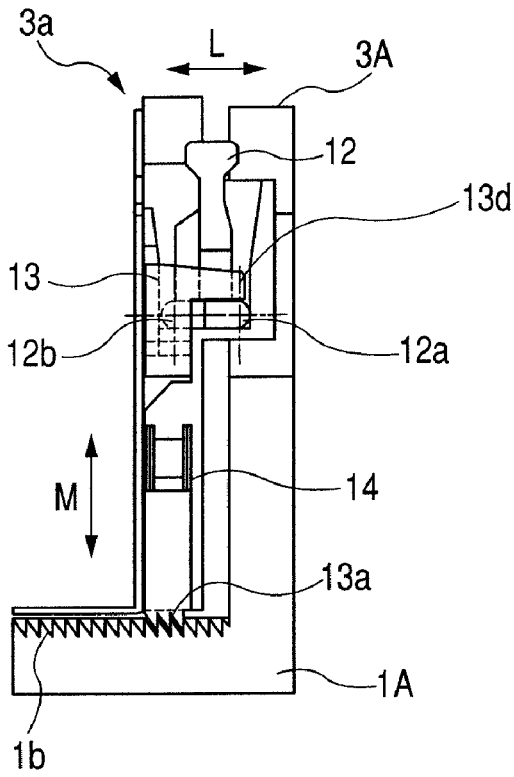
FIGS. 10A and 10B are sectional views taken along the line XA-XA of FIG. 8 illustrating states of the interlock when the operating portion of the above-mentioned side edge regulating member is pivotally operated.
Figure 10B:
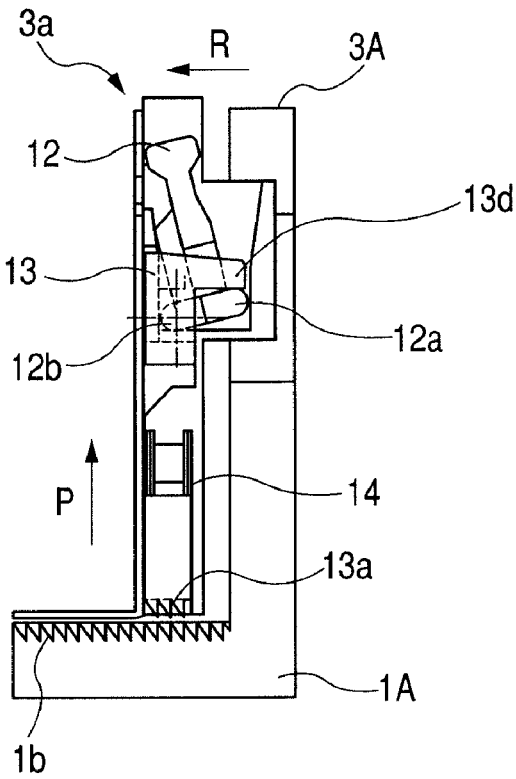

Likewise, to contain a sheet of a small size, when the operating portion 12 is pressed in the same direction indicated by an arrow R as the moving direction of the operating portion 12 so as to move one side edge regulating member 3*a* in the smaller size regulation direction indicated by the arrow R of FIG. 10B from the state of FIG. 1A, the operating portion 12 is pivoted with the support shaft 12*b* being the fulcrum. Then, when the operating portion 12 is pivoted in such a way, the support shaft 12*a* is brought into contact with the pressing portion 13*c* to press the holding member 13 upward (in a direction indicated by an arrow P).

Whereby, the engagement between the tooth row 13*a* provided at the holding member 13 and the rack tooth row 1*b* provided at the cassette body 1A is released, and one side edge regulating member 3*a* can be moved. Thus, one side edge regulating member 3*a* can be moved in the smaller size regulation direction to change a set position. Accompanied by this movement, the other side edge regulating member 3*b* is moved in the direction opposite to the moving direction of one side edge regulating member 3*a*. Incidentally, after having been moved, when the operating portion 12 is released form being pressed, by the action of the elastic member 14, the operating portion 12 is returned (in the direction indicated by the arrow P) to the original state in which the tooth row 13*a* and the rack tooth row 1*b* are engaged with each other, and thus the side edge regulating members 3*a* and 3*b* can be held (secured) in a set position.

With the arrangement, with the interlock 5C according to this embodiment, in both directions (directions indicated by the arrows N and R), being directions of one side edge regulating member 3*a* capable of moving in which the operating portion 12 is press-operated, the holding member 13 is moved in the direction indicted by the arrow P, and the engagement between the tooth row 13*a* and the rack tooth row 1*b* is released, so that one side edge regulating member 3*a* can be moved.

That is, in the case of moving the side edge regulating members 3*a* and 3*b*, only by pressing the operating portion 12 to be pivoted, the engagement between one side edge regulating member 3*a* and the cassette body 1A can be released.

Accordingly, only by pressing the operating portion 12 in the same direction as the moving direction of one side edge regulating member 3*a*, one side edge regulating member 3*a* can be released from being held and moved at the same time, the movement operability of the side edge regulating members 3*a* and 3*b* can be improved.

Incidentally, although in this embodiment, an example in which the present invention is applied to the side edge regulating members 3*a* and 3*b* is described, the same construction can be applied to the trailing edge regulating member 5.

Whereby, such the same effect that the operability of the trailing edge regulating member 5 can be improved, can be obtained.

In each of the above-mentioned embodiments, although by a meshing engagement between a tooth row of a holding member, being an engaging portion and a rack tooth row of a cassette body, being an engaged portion, regulating members are engaged, the engaging portion and the engaged portion are not limited to the construction of the meshing engagement of teeth. For example, making an engaging portion in a convex shape, and making an engaged portion in a concave shape, by the engagement of the convex portion with the concave portion, the regulating members can be held in a predetermined position.

In this embodiment, although an example in which the present invention is applied to a trailing edge regulating member or a side edge regulating member that is provided at a universal cassette is described, the present invention is not limited to this example. The present invention may be applied to a side edge regulating member to be provided at a manual tray of an image forming apparatus or an original tray for stacking an original of an original conveying apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-267953 filed Sep. 29, 2006, which is hereby incorporated by reference herein in its entirety.

What is claimed is:

1. A sheet feeding apparatus comprising:

a containing portion configured to contain sheets;

a regulating member movable in one direction or an other direction opposite to the one direction provided on the containing portion and configured to regulate a position of a sheet contained in the containing portion;

a holding mechanism holding the regulating member in a sheet regulated position corresponding to a sheet size, the holding mechanism having a holding member pivotably provided in a plane parallel to a bottom plate of the containing portion, the holding member including an engaging portion being able to engage with an engaged portion provided at the containing portion to hold the regulating member and pressing faces which face each other; and an operating portion pivotably provided at the regulating member and configured to release an engagement between the engaging portion and the engaged portion, the operating portion having a shaft being able to press the pressing faces, wherein the operating portion is press-operated in the one direction or the other direction intended to move the regulating member, thereby the shaft of the operating portion presses either one of the pressing faces and the holding member is pivoted in a same direction despite the one direction or the other direction in which the operating portion is press-operated, so that the regulating member is released from being held by the holding mechanism.

2. A sheet feeding apparatus according to claim 1, wherein in the holding mechanism, the regulating member can be held in the sheet regulated position by a meshing engagement of teeth, and in both the one direction and the other direction intended to move the regulating member in which the operating portion is press-operated, the meshing engagement of the teeth is released to move the regulating member in a pressed direction of the press-operation.

3. A sheet feeding apparatus according to claim 1, wherein the regulating member is a trailing edge regulating member for regulating a trailing edge position of the sheet to be contained.

4. A sheet feeding apparatus according to claim 1, wherein the regulating member is a side edge regulating member for regulating a side edge position of the sheet to be contained.

5. An image forming apparatus having a sheet feeding apparatus for feeding a sheet contained in a containing portion and an image forming portion for forming an image to the sheet fed by the sheet feeding apparatus, the image forming apparatus comprising:

a regulating member movable in one direction or an other direction opposite to the one direction provided on the containing portion and configured to regulate a position of the sheet contained in the containing portion;

a holding mechanism holding the regulating member in a sheet regulated position corresponding to a sheet size, the holding mechanism having a holding member pivotably provided in a plane parallel to a bottom plate of the containing portion, the holding member including an engaging portion being able to engage with an engaged portion provided at the containing portion to hold the regulating member and pressing faces which face each other; and an operating portion pivotably provided at the regulating member and configured to release an engagement between the engaging portion and the engaged portion the operating portion having a shaft being able to press the pressing faces, wherein the operating portion is press-operated in the one direction or the other direction intended to move the regulating member, thereby the shaft of the operating portion presses either one of the pressing faces and the holding member is pivoted in a same direction despite the one direction or the other direction in which the operating portion is press-operated, so that the regulating member is released from being held by the holding mechanism.

6. An image forming apparatus according to claim 5, wherein in the holding mechanism, the regulating member can be held in the sheet regulated position by a meshing engagement of teeth, and in both the one direction and the other direction intended to move the regulating member in which the operating portion is press-operated, the meshing engagement of the teeth is released to move the regulating member in a pressed direction of the press-operation.

7. An image forming apparatus according to claim 5, wherein the regulating member is a trailing edge regulating member for regulating a trailing edge position of the sheet to be contained.

8. An image forming apparatus according to claim 5, wherein the regulating member is a side edge regulating member for regulating a side edge position of the sheet to be contained.

* * * * *